US005228241A

United States Patent [19]

Ohta et al.

[11] Patent Number: 5,228,241

[45] Date of Patent: Jul. 20, 1993

[54] METHOD AND MACHINE FOR GRINDING

[75] Inventors: Norio Ohta, Okazaki; Yukio Oda, Kariya; Hisashi Nakamura, Nagoya; Toshiaki Naya, Kariya, all of Japan

[73] Assignee: Toyoda Koki Kabushiki Kaisha, Kariya, Japan

[21] Appl. No.: 760,931

[22] Filed: Sep. 17, 1991

[30] Foreign Application Priority Data

Sep. 28, 1990 [JP] Japan ..... 2-262265

[51] Int. Cl.[5] ..... B24B 5/04

[52] U.S. Cl. ..... 51/165.71; 51/327; 51/289 R; 51/105 SP

[58] Field of Search ..... 51/165.77, 165.71, 289 R, 51/326, 327, 206 R, 207, 49, 165 R, 105 SP

[56] References Cited

U.S. PATENT DOCUMENTS

| | | | |
|---|---|---|---|
| 3,802,130 | 4/1974 | Lindenbeck | 51/207 |
| 4,773,187 | 9/1988 | Ohta | 51/165.77 |
| 4,942,695 | 7/1990 | Wedeniwski | 51/165 R |
| 5,063,714 | 11/1991 | Meyer | 51/206 R |

FOREIGN PATENT DOCUMENTS

| | | | |
|---|---|---|---|
| 0406775 | 1/1991 | European Pat. Off. . | |
| 3136441 | 3/1983 | Fed. Rep. of Germany . | |
| 3817453 | 11/1989 | Fed. Rep. of Germany . | |
| 0079954 | 4/1987 | Japan | 51/165.77 |
| 1565666 | 5/1990 | U.S.S.R. | 51/204 |
| 2067937 | 8/1981 | United Kingdom . | |

*Primary Examiner*—Robert A. Rose

*Attorney, Agent, or Firm*—Oblon, Spivak, McClelland, Maier & Neustadt

[57] ABSTRACT

A machine for grinding a cylindrical surface and the end surface of a shoulder portion, both formed on a workpiece, using an angular grinding wheel. The end surface is perpendicular to the cylindrical surface. The grinding wheel has a first outer surface parallel to the axis of the workpiece and a second outer surface perpendicular to the first outer surface. The first outer surface has a cylinder-grinding parallel surface and a cylinder-grinding tilted surface. The parallel surface has a generatrix parallel to the generatrix of the cylindrical surface to be ground. The tilted surface is continuous with the parallel surface and has a generatrix tilted away from the generatrix of the cylindrical surface. The second outer surface has a shoulder-grinding parallel surface and a shoulder-grinding tilted surface continuous with this parallel surface. The shoulder-grinding parallel surface has a generatrix parallel to the end surface of the shoulder portion. The shoulder-grinding tilted surface has a generatrix tilted away from the end surface of the shoulder portion. The grinding wheel is fed into the shoulder portion from a given position located radially inside the end surface. Then, the wheel is moved radially outwardly to grind the end surface. Subsequently, the wheel is moved relative to the workpiece along the generatrix of the cylindrical surface away from the end surface to grind the cylindrical surface.

2 Claims, 6 Drawing Sheets

METHOD AND MACHINE FOR GRINDING

BACKGROUND OF THE INVENTION

1. Field of the Invention

The present invention relates to a method and a machine for grinding cylindrical surfaces of workpieces with a circular grinding wheel.

2. Description of the Prior Art

A conventional angular grinding wheel is shown in FIG. 1, where a workpiece W has a cylindrical surface and a shoulder portion to be ground. The grinding wheel has a cylinder-grinding surface 1 and a shoulder-grinding surface 2 perpendicular to the cylinder-grinding surface 1 whose generatrix is parallel to the generatrix of the cylindrical surface to be ground. The shoulder-grinding surface 2 grinds the shoulder portion of the workpiece. Where the cylindrical surface is ground with this angular grinding wheel, the wheel is moved toward the central line of the workpiece W in a direction intersecting the cylindrical surface so that the wheel may be fed into the workpiece. Then, the wheel is moved relative to the workpiece along the generatrix of the cylindrical surface. As a result, the cylindrical surface of the workpiece W is machined with the cylinder-grinding surface 1 of the angular grinding wheel by traverse grinding.

Since the cylinder-grinding surface 1 of this grinding wheel is completely parallel to the generatrix of the ground cylindrical surface, the front edge E of the grinding surface 1 as viewed in the direction of movement as shown in FIG. 1 is worn too quickly.

In the conventional traverse grinding, it is difficult to obtain a desired surface finish and quite accurate dimensional tolerances if the grinding wheel traverses the cylindrical surface of the workpiece only once. Therefore, three machining steps, i.e., rough grinding, accurate grinding, and finishing grinding, are normally needed. Consequently, it is impossible to machine the cylindrical surface in a short time.

SUMMARY OF THE INVENTION

It is an object of the present invention to provide a method and a machine which prevent the grinding surface of the used grinding wheel from being worn locally.

It is another object of the invention to provide a method and a machine which can complete the grinding of the cylindrical surface of a workpiece by moving a grinding wheel along the cylindrical surface of the workpiece only once.

In brief, in accordance with the present invention, a circular grinding wheel is used which has a cylinder-grinding surface comprising a parallel grinding surface and a tilted grinding surface. The parallel grinding surface has a generatrix parallel to the generatrix of the cylindrical surface of a workpiece to be ground. The tilted grinding surface is continuous with the parallel grinding surface and has a generatrix tilted away from the generatrix of the cylindrical surface. This circular grinding wheel is moved relative to the workpiece toward the central axis of the workpiece in a direction intersecting the cylindrical surface over a distance corresponding to the grinding allowance. Then, the cylindrical surface is machined by the tilted grinding surface. Subsequently, the grinding wheel is moved relative to the workpiece along the generatrix of the cylindrical surface in such a direction that the cylindrical surface is ground by the parallel grinding surface. Thus, the cylindrical surface is machined accurately. As a result, desired dimensions are obtained.

In the above-described method according to the invention, the tilted grinding surface makes no local contact with the cylindrical surface of the workpiece. Hence, the grinding wheel is prevented from wearing down locally too quickly. After the tilted grinding surface grinds the workpiece, the parallel grinding surface continuous with the tilted grinding surface performs a finishing grinding operation on the cylindrical surface. In consequence, no separate finishing grinding operation is needed. Also, the machining efficiency can be enhanced.

A grinding machine according to the invention comprises a circular grinding wheel having a parallel grinding surface and a tilted grinding surface continuous with the parallel grinding surface. This parallel grinding surface has a generatrix parallel to the generatrix of a cylindrical surface to be ground. The tilted grinding surface has a generatrix tilted away from the generatrix of the cylindrical surface. A control means causes the grinding wheel to move relative to the workpiece into the cylindrical surface. The wheel is fed into the cylindrical surface to a depth corresponding to the grinding allowance. Then, the cylindrical surface is ground by the tilted grinding surface. Subsequently, the grinding wheel is moved relative to the workpiece along the generatrix of the cylindrical surface in such a direction that the cylindrical surface is ground by the parallel grinding surface. In this way, the above-described objects of the invention are achieved.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
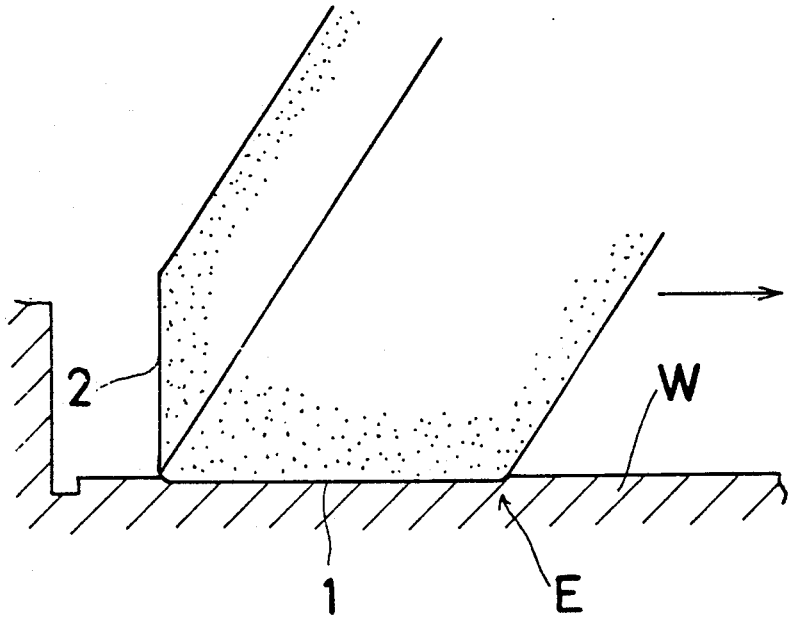
FIG. 1 (PRIOR ART)
FIG. 1 is a cross-sectional view of a grinding wheel and a workpiece, and in which the workpiece in contact with the grinding wheel is machined by the prior art traverse grinding.
Figure 2:
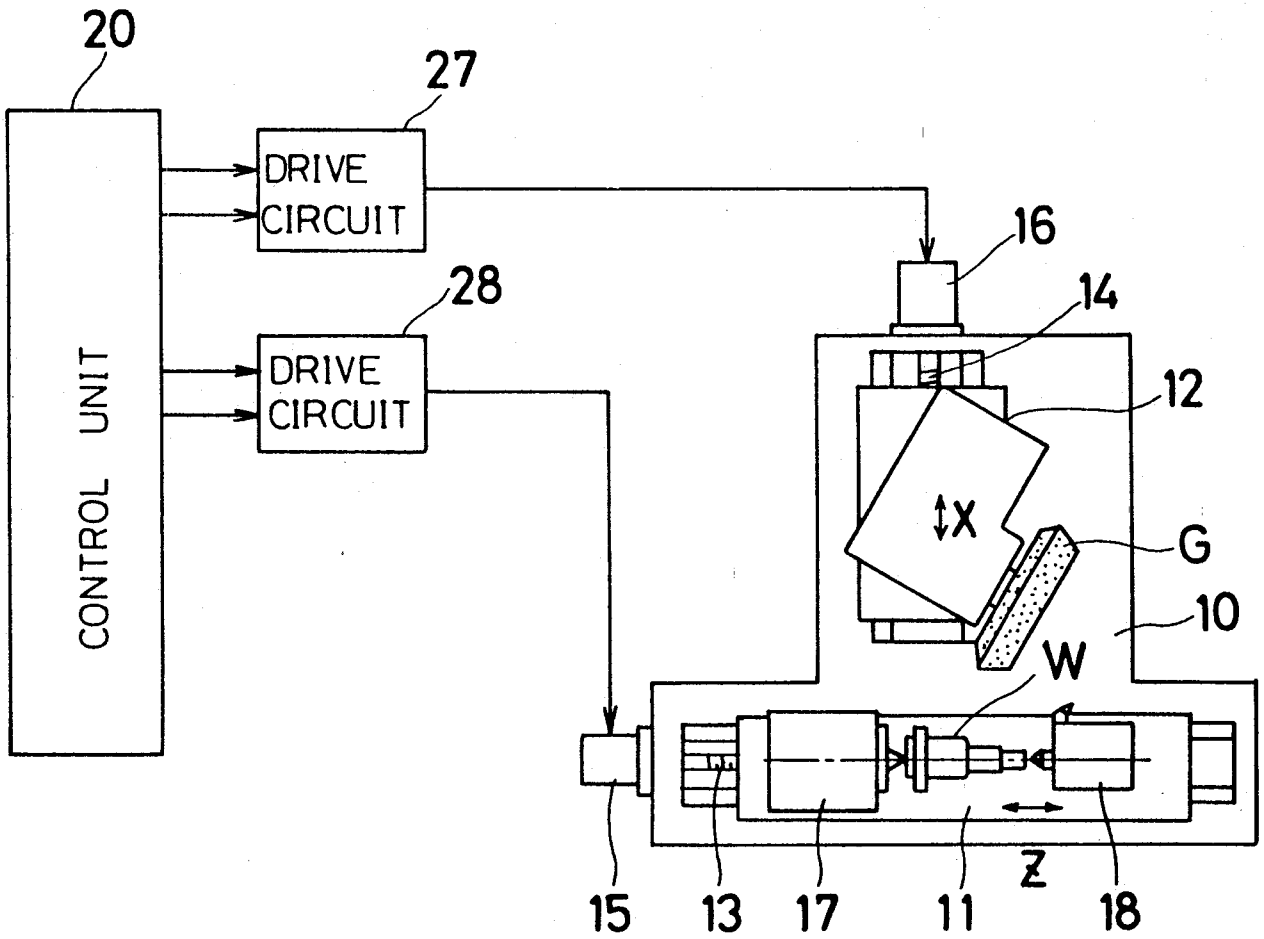
FIG. 2 is a block diagram of a CNC grinding machine according to the invention.

Referring to FIG. 2, there is shown a CNC grinding machine according to the invention. This machine has a bed 10 on which a wheel spindle stock 12 and a work table 11 are guided so a to be movable in the directions of X- and Y-axes, respectively, which are perpendicular to each other. A wheel spindle is held to the spindle stock 12 so as to be rotatable about an axis which is inclined at a given angle $\gamma$ to the axis of rotation of a cylindrical workpiece W (described later) within a horizontal plane. An angular grinding wheel G is mounted to one end of the wheel spindle and driven by an electric motor (not shown). This grinding wheel G comprises a metallic disk and a layer of abrasive grains of CBN (cubic system of boron nitride) formed on the outer periphery of the disk. The abrasive grains are bonded together with a metal bond. This wheel G is narrower than the conventional grinding wheel.

A headstock 17 and a tailstock 18 are disposed opposite to each other on the table 11. The workpiece W is held by the headstock 17 and the tailstock 18 in such a way that the workpiece can rotate about an axis parallel to the direction of the Z-axis in which the table 11 is moved. The workpiece W is rotated by a spindle motor (not shown). Feed screws 14 and 13 are screwed to the spindle stock 12 and the table 11, respectively. These screws 13 and 14 are rotated by servomotors 15 and 16, respectively. The servomotors 15 and 16 are connected with drive circuits 28 and 27, respectively, and are controlled by instruction pulses supplied from a control unit 20 that is connected with the drive circuits 27, 28 to provide a numerical control of the servomotors.

Figure 3:
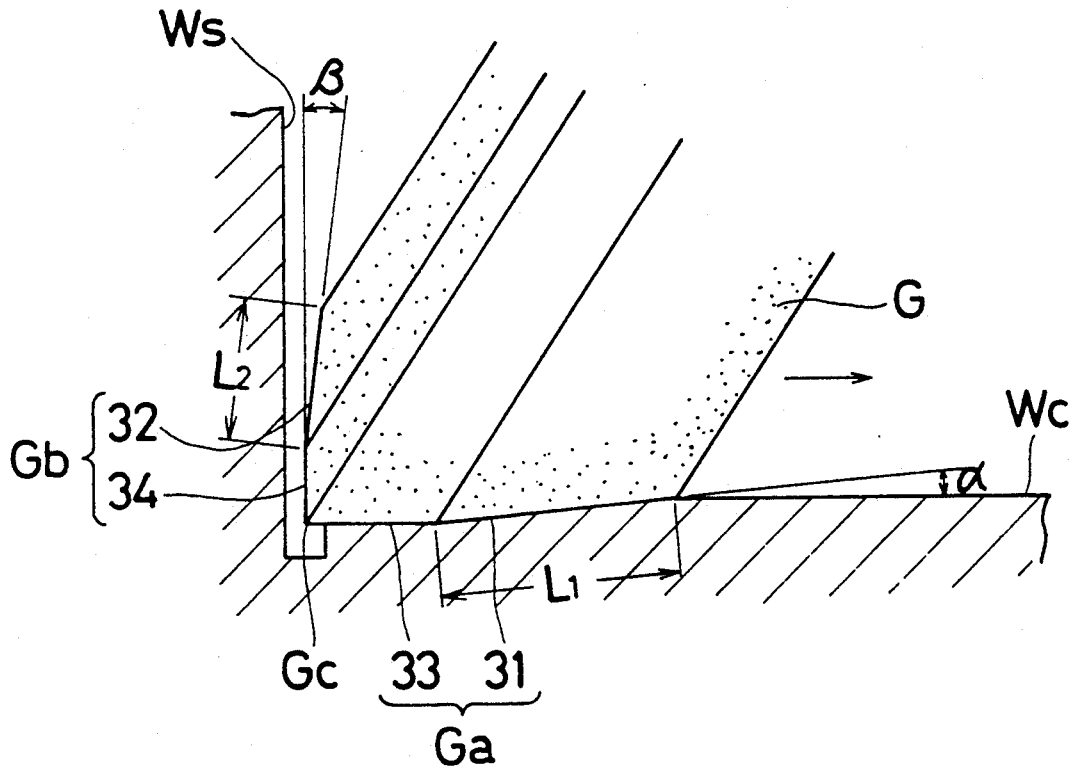
FIG. 3 is a fragmentary enlarged view of the angular grinding wheel shown in FIG. 2.

FIG. 3 is an enlarged view of the angular grinding wheel G, for showing its shape. The workpiece W has a cylindrical surface Wc. A cylinder-grinding surface Ga for grinding the cylindrical surface Wc and a shoulder-grinding surface Gb are formed on the grinding wheel G. The shoulder-grinding surface Gb acts to grind the end surface of the shoulder portion adjacent to the cylindrical surface Wc. An arc-shaped apical portion Gc having a given radius is formed between the cylinder-grinding surface Ga and the shoulder-grinding surface Gb. The cylinder-grinding surface Ga is composed of a cylinder-grinding tilted surface 31 and a cylinder-grinding parallel surface 33 formed between the tilted surface 31 and the apical portion Gc. This tilted surface 31 is a truncated conical surface which continues to the cylinder-grinding parallel surface 33 at the end on the side of the apical portion Gc. The distance between the truncated conical surface and the generatrix of the cylindrical surface Wc increases in going away from the cylinder-grinding parallel surface 33. The conical surface is tilted at angle $\alpha$ to the cylindrical surface Wc. The shoulder-grinding surface Gb comprises a shoulder-grinding tilted surface 32 and a shoulder-grinding parallel surface 34 formed between the tilted surface 32 and the apical portion Gc. This tilted surface 32 is a truncated conical surface which continues to the shoulder-grinding parallel surface 34 at the end on the side of the apical portion Gc. The distance between this conical surface and the end surface Ws of the shoulder portion of the workpiece increases in going away from the shoulder-grinding parallel surface 34. This conical surface is inclined at angle $\beta$ to the end surface Ws of the shoulder portion.

As described above, the generatrix of the cylinder-grinding tilted surface 31 is inclined at the preset angle $\alpha$ in the direction to move away from the generatrix of the cylindrical surface Wc of the workpiece W. The generatrix of the shoulder-grinding tilted surface 32 is inclined at the preset angle $\beta$ in the direction to move away from the end surface Ws of the shoulder portion of the workpiece W. Let $L_1$ and $L_2$ be the cross-sectional lengths of the cylinder-grinding tilted surface 31 and the shoulder-grinding tilted surface 32, respectively. The angles $\alpha$ and $\beta$ are so set that $L_1\sin\alpha$ and $L_2\sin\beta$ correspond to the finishing grinding allowances for the cylindrical surface Wc and the end surface Ws of the shoulder portion, respectively.

The cylinder-grinding parallel surface 33 and the shoulder-grinding parallel surface 34 are parallel to the cylindrical surface Wc and the end surface Ws of the shoulder portion, respectively, at the grinding point. Since the diameter of the grinding wheel is large, the cylinder-grinding parallel surface 33 has a larger peripheral speed and experiences less resistance compared with the cylinder-grinding tilted surface 31. Therefore, during grinding operation, the workpiece W flexes only a little. The cylinder-grinding parallel surface 33 functions well as a finishing grinding portion for the cylindrical surface Wc of the workpiece W. For the same reason, the shoulder-grinding parallel surface 34 functions well as a finishing grinding portion for the end surface Ws of the shoulder portion of the workpiece W.

Figure 4:
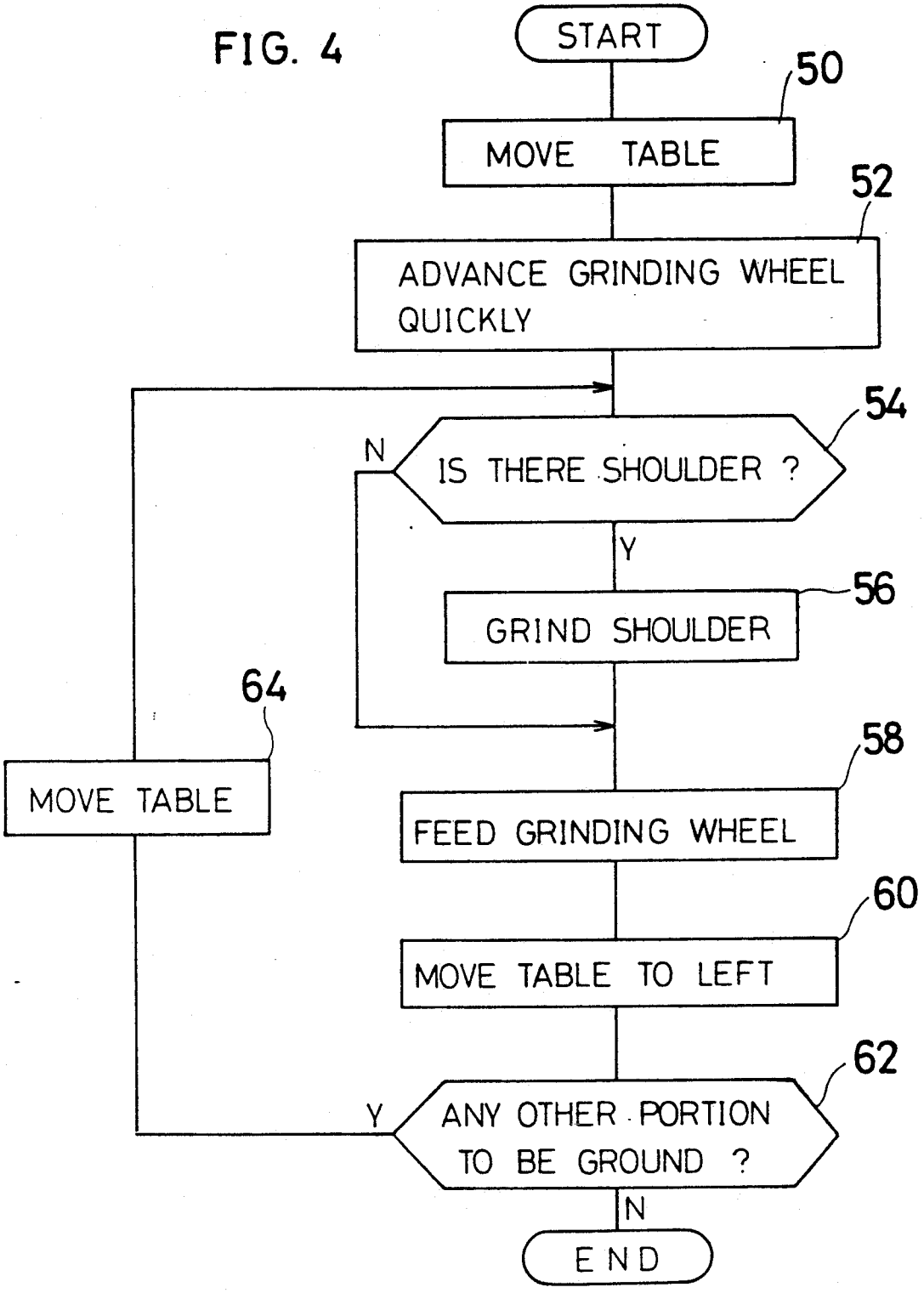
FIG. 4 is a flowchart illustrating the operation of the control unit shown in FIG. 2.
Figure 5:
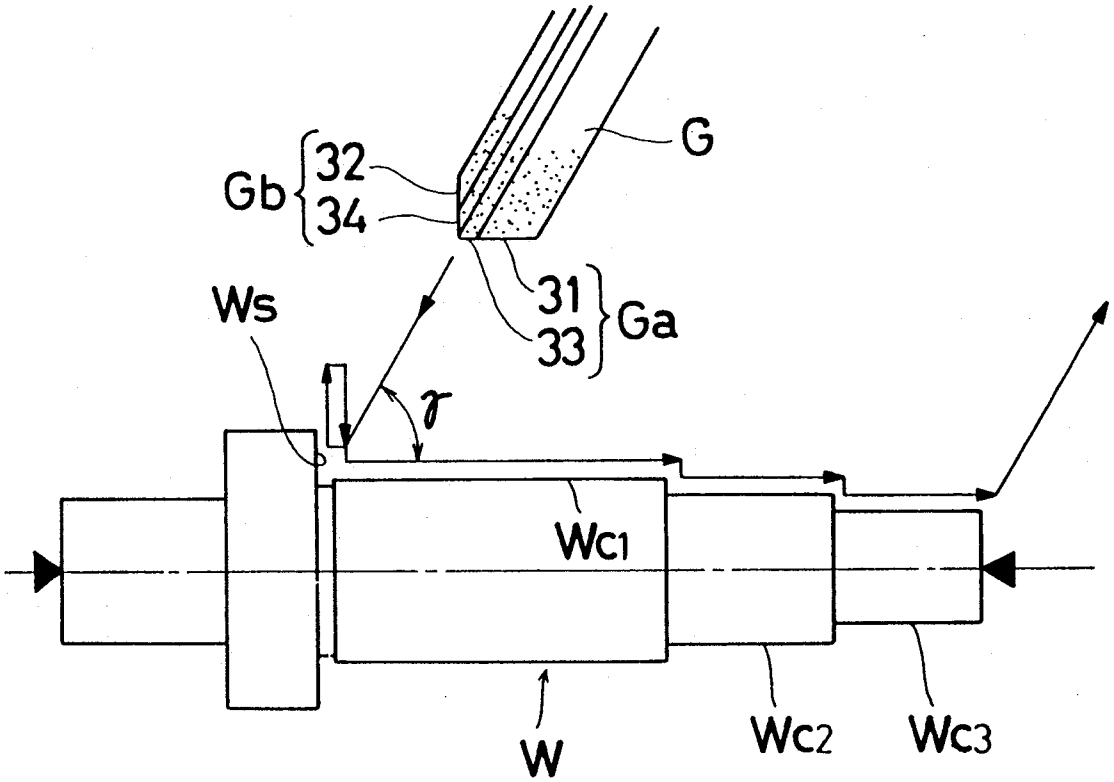
FIG. 5 is a view illustrating the sequence in which plural cylindrical surfaces of a workpiece are ground.

The manner in which the grinding machine constructed as described above grinds the workpiece is next described by referring to FIGS. 4 and 5. FIG. 4 is a flowchart illustrating the operation of the control unit 20. First, the table 11 is moved in the direction of the Z-axis (step 50). The first cylindrical surface Wc1 is placed at the machining position. Then, the table 11 is moved to the right and, at the same time, the spindle stock 12 is advanced to quickly place the grinding wheel G at the position corresponding to the end of the first cylindrical surface Wc1 close to the end surface Ws of the shoulder portion. (step 52). A decision is made to determine whether there exists a shoulder portion end surface which is adjacent to the cylindrical surface Wc1 and should be machined (step 54). If such a shoulder portion does not exist, then step 56 is skipped, and control goes to step 58. In this case, there exists the end surface Ws of the shoulder portion to be machined and so control goes from step 52 to step 56, where the end surface Ws of the shoulder portion is ground. In this step 56, the table 11 is first moved to the right over a given distance at a given infeed speed. The shoulder-grinding surface Gb of the grinding wheel G is fed into the end surface W2 of the shoulder portion by a given grinding allowance. Thereafter, the spindle stock 12 is moved backward at a given grinding speed. Thus, the end surface Ws of the shoulder portion of the workpiece W is first ground by the shoulder-grinding tilted surface 32. Subsequently, a finishing grinding operation is performed by the shoulder-grinding parallel surface 34. When the machining of the end surface Ws of the shoulder portion is completed, the table 11 is moved to the left over a given distance to form a certain clearance between the grinding wheel G and the end surface Ws of the shoulder portion. Thereafter, the spindle stock 12 is advanced again at a high speed back into its original radial position. Then, the spindle stock 12 is fed into the workpiece W toward the axis of rotation of the workpiece to feed the wheel into the first cylindrical surface Wc1 to a given depth corresponding to the grinding allowance (step 58). The table 11 is moved to the left. In this process, the first cylindrical surface Wc1 of the workpiece W is first roughly ground by the cylinder-grinding tilted surface 31. Then, the cylinder-grinding parallel surface 33 performs a finishing grinding operation (step 60). At this time, as shown in FIG. 3, the cylindrical surface Wc is ground by the whole of the cylinder-grinding tilted surface 31 and, therefore, excessive local wear of the angular grinding wheel G is prevented. Also, the machining of the cylindrical surface Wc1 is completed by a single traverse grinding operation, because a finishing grinding operation is carried out by the cylinder-grinding parallel surface 33 after the cylindrical surface Wc1 is roughly ground by the cylinder-grinding tilted surface 31. Consequently, the grinding time can be shortened. Similarly, the prevention of the excessive wear and the shortening of the grinding time can be attained by the shoulder-grinding tilted portion 32 and the shoulder-grinding parallel surface 34. After the completion of the machining of the first cylindrical surface Wc1, control proceeds to step 62, where a decision is made to determine whether there exists any other portion to be ground. If not so, the grinding process is ended. On the other hand, if the result of the decision is that there exists any portion to be ground other than the first cylindrical surface as in the present example, then control goes to step 64, where the next second cylindrical surface Wc2 is brought into the machining position. The grinding wheel G is placed at the left end of the second cylindrical surface Wc2. Subsequently, the processing beginning with step 54 is performed again to machine the second cylindrical surface Wc2. The third machined surface Wc3 is machined in the same way.

It is to be understood that the present invention is also applicable to the case in which a taper is ground on a workpiece. In this case, the table is inclined in such a way that the generatrix of the tapering cylindrical surface is parallel to the direction of movement of the table at the machining position. Under this condition, the taper is ground.

Figure 6:
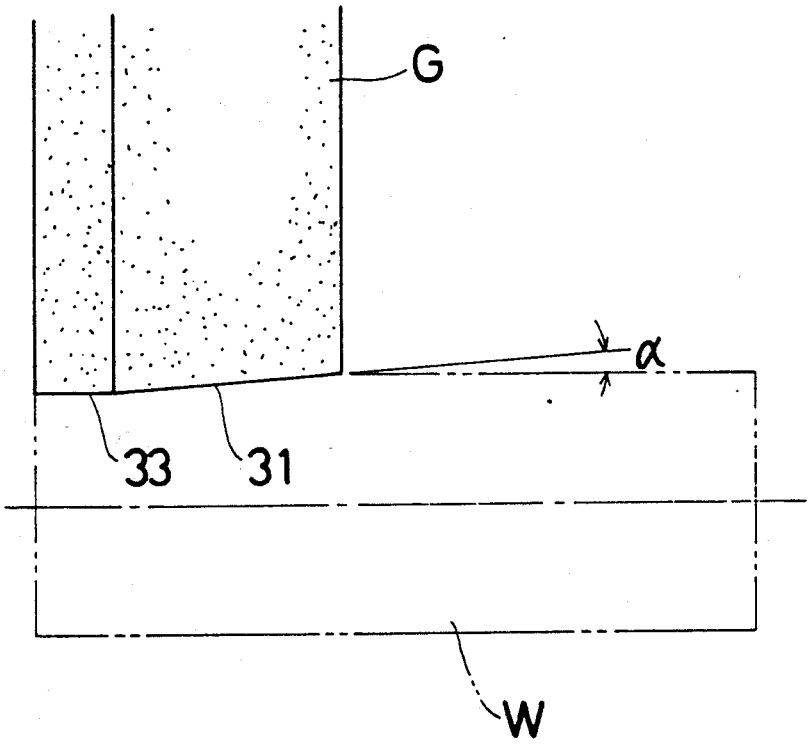
FIG. 6 is a fragmentary enlarged view of a modified example of the grinding wheel according to the invention.

In the above example, an angular grinding wheel is used. As shown in FIG. 6, a grinding wheel having only an outer surface parallel to the axis of rotation of the workpiece may also be employed. In this case, this outer surface has a grinding parallel surface 33 and a grinding tilted surface 31. The parallel surface 33 has a generatrix parallel to the generatrix of the cylindrical surface to be ground. The tilted surface 31 is continuous with the parallel surface 33 and has a generatrix inclined away from the generatrix of the cylindrical surface.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding a cylindrical surface and the end surface of a shoulder portion formed on a workpiece, using an angular grinding wheel having a first outer surface parallel to the axis of rotation of the workpiece, a second outer surface perpendicular to the first outer surface, and an apical portion formed between the first and second outer surfaces, the end surface of the shoulder portion of the workpiece being perpendicular to the cylindrical surface, said method comprising the steps of:

forming a cylinder-grinding parallel surface on the first outer surface of the grinding wheel adjacently to the apical portion, the parallel surface having a generatrix parallel to the generatrix of the cylindrical surface to be ground;

forming a cylinder-grinding tilted surface continuous with the cylinder-grinding parallel surface, the tilted surface being inclined away from the generatrix of the cylindrical surface;

forming a shoulder-grinding parallel surface on the second outer surface of the grinding wheel adjacently to the apical portion, the shoulder-grinding parallel surface having a generatrix parallel to the end surface of the shoulder portion to be ground;

forming a shoulder-grinding tilted surface continuous with the shoulder-grinding parallel surface, the shoulder-grinding tilted surface having a generatraix inclined away from the end surface of the shoulder portion;

rotating the workpiece and the grinding wheel about their respective axes;

moving the grinding wheel into the end surface from a given position located radially inside the end surface of the shoulder portion to feed the wheel into the end surface of the shoulder portion to a depth corresponding to a grinding allowance;

then moving the grinding wheel radially outwardly along the end surface to grind it;

moving the grinding wheel into the cylindrical surface to feed the wheel into the cylindrical surface to a depth corresponding to the grinding allowance; and then moving the grinding wheel along the generatrix of the cylindrical surface away from the end surface to grind the cylindrical surface.

2. A machine for grinding a workpiece, comprising:

a workpiece support means which holds the workpiece and rotates it about its central axis;

a circular grinding wheel having a cylinder-grinding parallel surface and a cylinder-grinding tilted surface, the cylinder-grinding parallel surface having a generatrix parallel to the generatrix of a cylindrical surface of the workpiece to be ground, the cylinder-grinding tilted surface being continuous with the cylinder-grinding parallel surface and having a generatrix inclined away from the generatrix of the cylindrical surface; and a shoulder-grinding parallel surface perpendicular to the cylinder-grinding parallel surface and a shoulder-grinding tilted surface, the shoulder-grinding tilted surface being continuous with the shoulder-grinding parallel surface and having a generatrix inclined away from the end surface of a shoulder portion of the workpiece;

a grinding wheel support means which holds the grinding wheel and rotates it about its central axis;

a means for varying the position of the grinding wheel support means relative to the workpiece support means in a first and a second directions which are perpendicular to each other, the first direction being parallel to the central axis or the workpiece;

a first control means which moves the grinding wheel into the cylindrical surface to effect infeed movement of the grinding wheel by a depth corresponding to grinding allowance and which then moves the grinding wheel relative to the workpiece along the generatrix of the cylindrical surface in such a direction that the cylindrical surface is ground first by the cylinder-grinding tilted surface and then by the cylinder-grinding parallel surface; and a second control means which moves the grinding wheel into the end surface from a given position located radially inside the end surface of the shoulder portion to feed the wheel into the end surface to a depth corresponding to grinding allowance, and then moves the grinding wheel along the end surface radially outwardly to grind the end surface.

* * * * *

UNITED STATES PATENT AND TRADEMARK OFFICE

CERTIFICATE OF CORRECTION

PATENT NO. : 5,228,241

DATED : July 20, 1993

INVENTOR(S) : Norio Ohta et al.

It is certified that error appears in the above-indentified patent and that said Letters Patent is hereby corrected as shown below:

On the title page, Item [30],

The Foreign Application Priority Data should be deleted.

Signed and Sealed this

Twenty-second Day of March, 1994

*Attest:*

*Attesting Officer*

BRUCE LEHMAN

*Commissioner of Patents and Trademarks*